US006415728B1

(12) United States Patent
Maeda et al.

(10) Patent No.: US 6,415,728 B1
(45) Date of Patent: Jul. 9, 2002

(54) PERSONAL WATERCRAFT

(75) Inventors: Kiyoaki Maeda, Kobe; Yoshinori Tsumiyama, Miki; Kenichi Nakagawa, Kobe; Takehiro Nakashima, Akashi, all of (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/717,156

(22) Filed: Nov. 22, 2000

(30) Foreign Application Priority Data

Nov. 25, 1999 (JP) ..... 11-334071

(51) Int. Cl.[7] ..... B63C 7/00
(52) U.S. Cl. ..... 114/55.5; 114/357; 440/111
(58) Field of Search ..... 440/111, 112, 440/38; 114/55.5, 357

(56) References Cited

U.S. PATENT DOCUMENTS

| | | | | | |
|---|---|---|---|---|---|
| 921,913 | A | * | 5/1909 | Thompson | 440/112 |
| 2,059,220 | A | * | 11/1936 | Fernstrum | 440/111 |
| 2,569,802 | A | * | 10/1951 | Daniels | 440/63 |
| 2,617,377 | A | * | 11/1952 | Evans | 114/191 |
| 3,057,320 | A | * | 10/1962 | Daniels | 440/62 |
| 3,223,067 | A | * | 12/1965 | Horan | 440/53 |
| 3,806,971 | A | * | 4/1974 | Elling | 114/348 |
| 3,855,044 | A | * | 12/1974 | Riel | 442/19 |
| 3,935,832 | A | * | 2/1976 | Bawden et al. | 440/111 |
| 4,768,983 | A | * | 9/1988 | Smith | 440/111 |
| 4,996,937 | A | * | 3/1991 | Niina et al. | 114/144 R |
| 5,388,544 | A | * | 2/1995 | Kobayashi | 114/248 |
| 5,437,568 | A | * | 8/1995 | Kobayashi | 440/38 |
| 5,460,553 | A | * | 10/1995 | Craig et al. | 440/38 |
| 5,695,371 | A | * | 12/1997 | Katoh | 440/111 |
| 5,921,198 | A | * | 7/1999 | Yoshida | 114/357 |
| 6,032,606 | A | * | 3/2000 | Fulks | 114/357 |
| 6,205,942 | B1 | * | 3/2001 | Tsumiyama | 114/55.5 |

FOREIGN PATENT DOCUMENTS

| | | | |
|---|---|---|---|
| JP | U-58-145298 | 9/1983 | |
| JP | 63-297187 | * 12/1988 | 440/111 |
| JP | 02-169385 | * 6/1990 | 440/112 |
| JP | U-5-27270 | 4/1993 | |
| JP | 08-104286 | * 4/1996 | 440/112 |
| JP | 08-104287 | * 4/1996 | 440/111 |
| JP | 08-104295 | * 4/1996 | 440/111 |
| JP | B2-2826273 | 9/1998 | |
| JP | 2000-16375 | * 1/2000 | 440/112 |
| JP | 2001-151186 | * 5/2001 | 440/111 |

* cited by examiner

*Primary Examiner*—S. Joseph Morano
*Assistant Examiner*—Ajay Vasudeva
(74) *Attorney, Agent, or Firm*—Oliff & Berridge PLC

(57) ABSTRACT

An inner frame member, of a length that is less than the entire length of a hull, is joined to the inner surface of the hull that forms a lower portion of a body of a personal watercraft. The inner frame member has an engine mount portion that supports an engine thereon, an impeller shaft support region that supports thereon an impeller shaft of a propulsion device driven by the engine, and bulkheads extending in the lateral direction of the hull and joined to the inner surface of the hull. In accordance with the present invention, the personal watercraft is light weight, but also retains rigidity and assembling efficiency of the hull.

16 Claims, 5 Drawing Sheets

PERSONAL WATERCRAFT

BACKGROUND OF THE INVENTION

1. Field of the Invention

This invention relates to a watercraft, and more particularly to a personal watercraft having an improved hull structure.

2. Description of the Related Art

Some personal watercrafts include a hull structure provided with a bulkhead for reinforcement that is joined to both the hull and a deck. According to this structure, the reinforcing effect can be achieved while keeping the weight of the hull low. However, an engine and a support portion (bearing portion) of an impeller shaft of a propulsion device are fixed directly to the hull without utilizing the bulkhead, so that it is difficult to accurately determine positions in which these parts are fixed.

Other examples of the hull structure of the personal watercraft include the hull structure disclosed in, for example, Japanese Patent No. 2826273. This hull structure is provided with the outer hull molded and constituting the lower portion of the hull, and the inner hull molded and disposed so as to be opposed to only the inner surface of the bottom wall of the outer hull. This inner hull extends in the longitudinal and lateral directions of the outer hull, and is joined to the bottom surface of the outer hull via ribs formed on both side portions thereof. This structure enables the strength of the hull to be improved. Moreover, since the inner hull is formed so that the engine, the fuel tank, the water muffler, the bearing supporting the impeller shaft of the propulsion device thereon, and the electric part box are mounted thereon, the dimensions of mount portions for these parts can be set at once. Accordingly, accurately determining the positions in which these parts are fixed can be done easily, and the assembling efficiency is improved. However, such a double hull structure having the outer and inner hull causes the weight of the hull to increase.

SUMMARY OF THE INVENTION

The present invention has been made in view of the above circumstances, and an object of the present invention is to provide a personal watercraft having a hull structure, capable of reducing the weight of a hull while maintaining the rigidity and assembling efficiency of the hull at high levels.

According to an aspect of the present invention, a personal watercraft has a hull, a deck, and an inner frame member joined to an inner surface of the hull, the inner frame member having an engine mount portion that supports an engine thereon and extends from a middle portion to a rear portion of the hull, an impeller shaft support region that supports thereon an impeller shaft of a propulsion device driven by the engine, and a bulkhead that extends in the lateral direction of the hull.

According to this structure, the inner frame member is provided over only a part of the whole length of the hull, i.e., this member is short, so that the weight of the hull decreases. Since the bulkheads that extend in the lateral direction of the hull are joined to an inner surface of the hull and divide the hull into plural compartments, the rigidity of the hull is improved. Moreover, since the inner frame member has an engine mount portion and an impeller shaft support region, the accuracy of positions in which the engine and the impeller shaft are fixed is improved. Therefore, the centering of the engine and impeller shaft thereof is done easily, and the hull assembling efficiency is improved.

It is preferable that the bulkhead that extends in the lateral direction of the hull is provided in the inner surface of the hull away from and forward of said inner frame member. With this structure dividing the hull into multiple compartments, the rigidity of the hull is improved.

It is preferable that the inner frame member is joined to both the inner surface of said hull and the deck via adhesive layers. With this structure, the rigidity of the hull and deck is improved.

These objectives as well as other features and advantages of the present invention will become more apparent to those skilled in the art from the following description with reference to the accompanying drawings.

BRIEF DESCRIPTION OF THE DRAWINGS

A preferred embodiment of the present invention is described in detail with reference to the following figures, wherein.

DESCRIPTION OF THE PREFERRED EMBODIMENT

Figure 1:
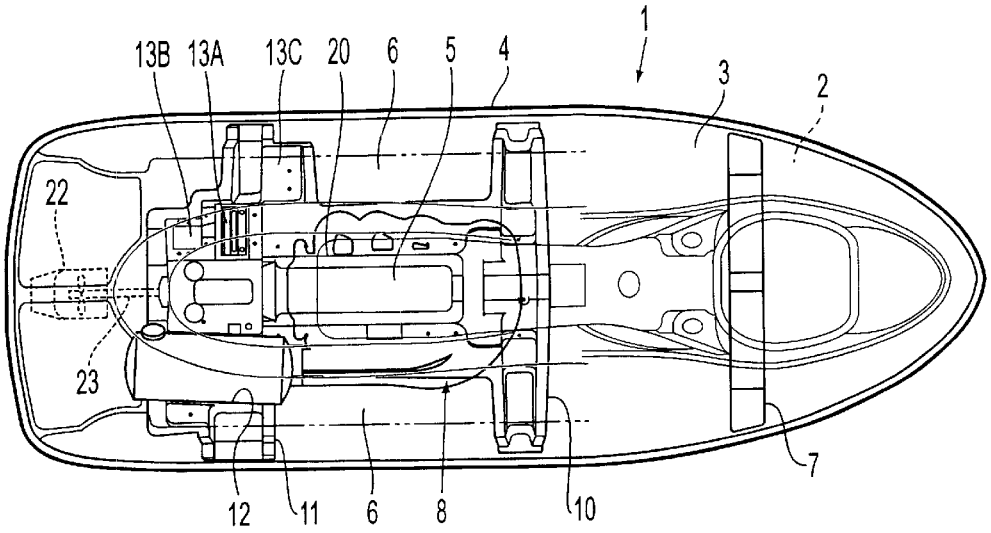
FIG. 1 is a plan view taken through a deck of a personal watercraft according to an embodiment of the present invention.

Embodiments of the present invention are described on the basis of the drawings. FIG. 1 is a plan view taken through a deck of a personal watercraft according to an embodiment of the present invention, and FIG. 2 is a side view taken through a hull and a deck of the personal watercraft shown in FIG. 1.

Figure 2:
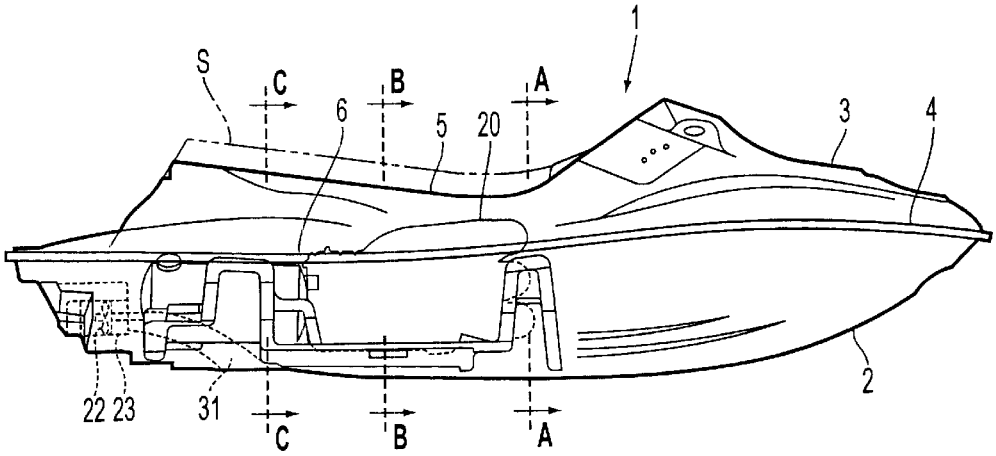
FIG. 2 is a side view taken through the deck and a hull of the personal watercraft shown in FIG. 1.

Referring to FIG. 2, a body 1 of the personal watercraft is formed by joining together a hull 2, of a resin constituting a lower portion of the body 1, and a deck 3 of a resin constituting an upper portion of the body 1 via an outer circumferential flange 4 shown in FIG. 1. On a central upper portion of the deck 3 shown in FIG. 2, a seat base 5 on which a rider's seat S is fixed is formed, and, on both sides of the seat base 5, steps 6 on which the feet of the rider are rested, are provided. A central part of a rear portion of the hull 2 is provided with a duct 31, made integral therewith as a recessed portion extending diagonally upward, and a water jet pump type propulsion device 22 is fixed to a rear portion of the duct 31. The propulsion device 22 is driven by an engine 20 mounted on the interior of the body 1.

Figure 3A:
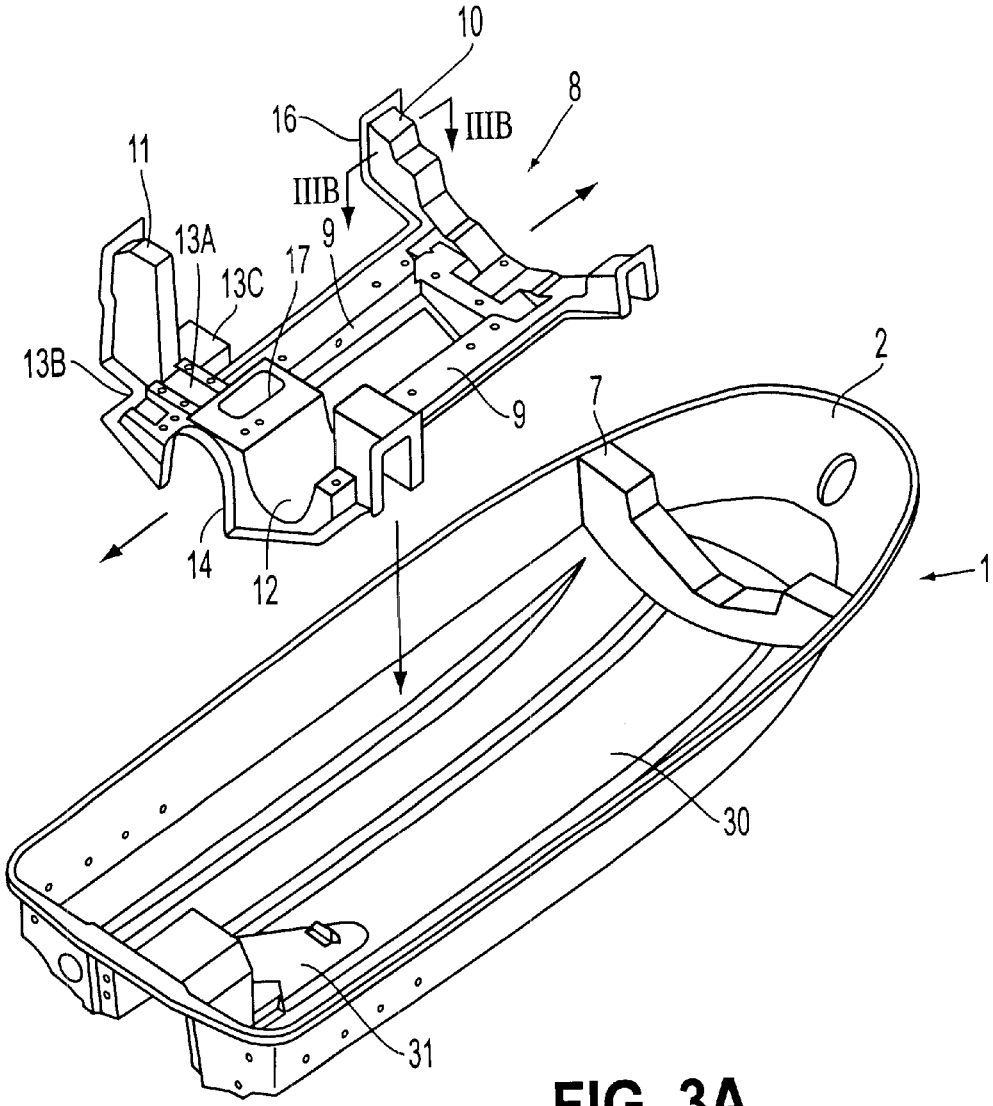
FIG. 3A is an exploded view in perspective showing the hull and an inner frame member which form a body of the personal watercraft.

As shown in the exploded view in perspective of FIG. 3A, a bulkhead 7, of a resin disposed closer to a bow and extending in the lateral direction, and an inner frame member 8 extending from a central portion of the body 1 to a rear portion thereof, are joined to an inner surface of the hull 2 by bonding. The inner frame member 8 is molded, and has engine mount portions 9 formed in a longitudinally intermediate section thereof, a bulkhead 10 formed at a front side of the engine mount portions 9 and extending in the lateral direction of the body 1, and a bulkhead 11 formed at a rear side of the engine mount portions 9 and extending in the lateral direction of the body 1. The engine mount portions 9 and the bulkheads 10, 11 are formed integrally.

The bulkhead 11 is provided with a silencer support region 12 formed in a semicircularly recessed manner at a starboard side section thereof, a first electric parts support region 13A formed at a port side section thereof and adapted to hold a power source, such as a battery therein, a second electric parts support region 13B formed at a rear side of the first electric parts support region 13A and adapted to hold an electric parts box therein, a drive machine fixing region 13C to which a drive machine, such as a motor that drives an exhaust gas control valve for an engine 20 (FIG. 2) is fixed, and a duct connecting region 14 formed at a laterally central rear section thereof and joined to a suction duct 31. The bulkhead 11 is further provided, as shown in FIG. 6, with an impeller shaft support region 15 positioned on a front side of the duct connecting region 14, this impeller shaft support region 15 supporting an impeller shaft 23 of the propulsion device 22 via a bearing 24.

Figure 3B:
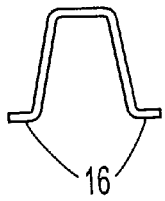
FIG. 3B is a sectional view taken along the line III—III in FIG. 3A.
Figure 4:
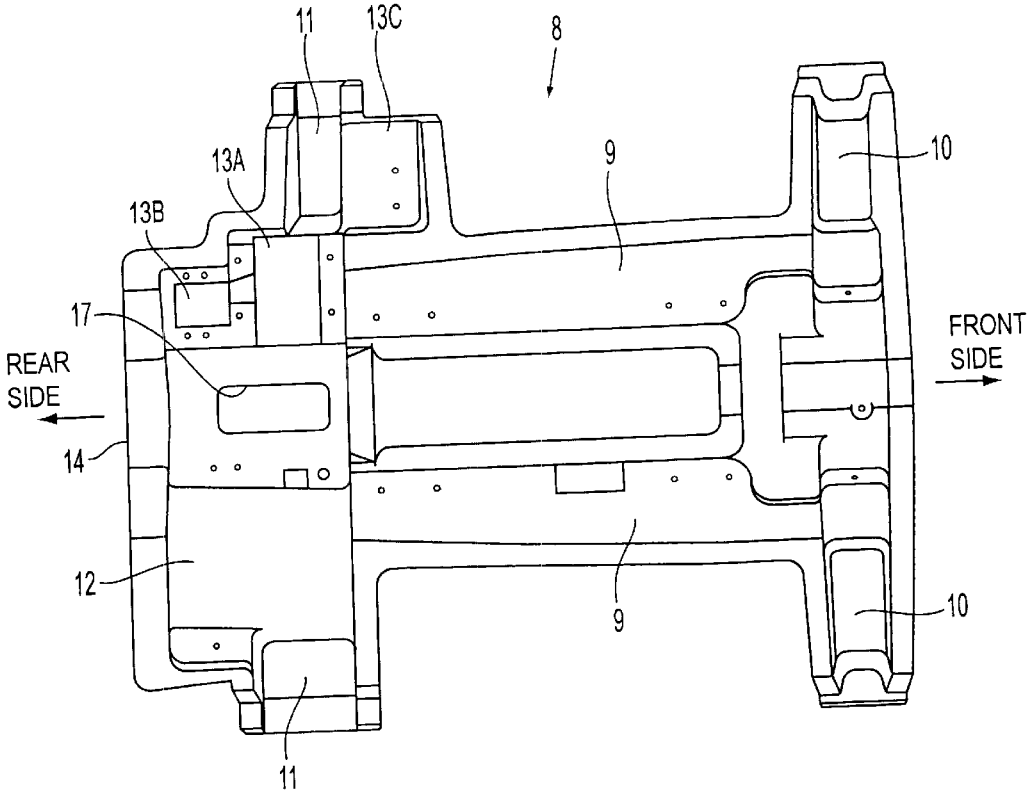
FIG. 4 is a plan view of the inner frame member.
Figure 5:
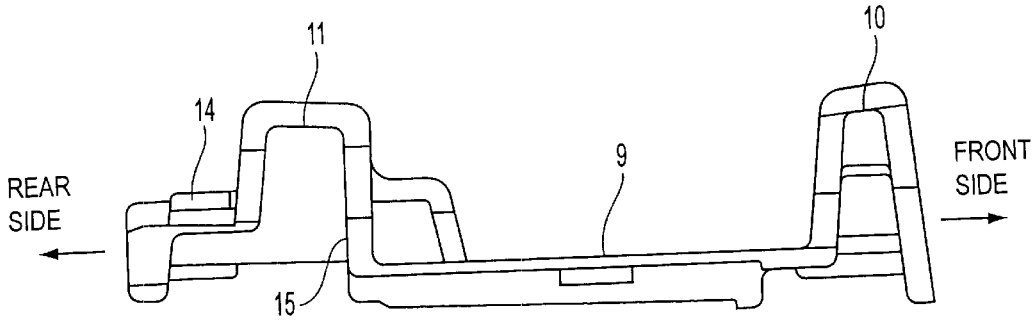
FIG. 5 is a side view of the inner frame member.

As shown in the plan view of FIG. 4, the bulkhead 10 is symmetric, and the engine mount portion 9 also substantially symmetric. In a rear part of the duct connecting region 14, an inspection panel 17 formed of a through hole is provided. As shown in the side view of FIG. 5, top surfaces of the bulkheads 10, 11 are set higher than that of the duct connecting region 14, which is set higher than that of the engine mount 9. The bulkheads 10, 11 of the inner frame member 8 are formed to a substantially inverted U-shaped cross section that is taken in the longitudinal direction of the hull, and have outwardly extending flanges 16 at lower opened ends thereof as shown in FIG. 3(*b*), which is a sectional view taken along the line III—III in FIG. 3(*a*), the flanges 16 being joined to a bottom surface which form a part of an inner surface of the hull 2 and inner surfaces of port and starboard side walls of the hull 2.

Figure 6:
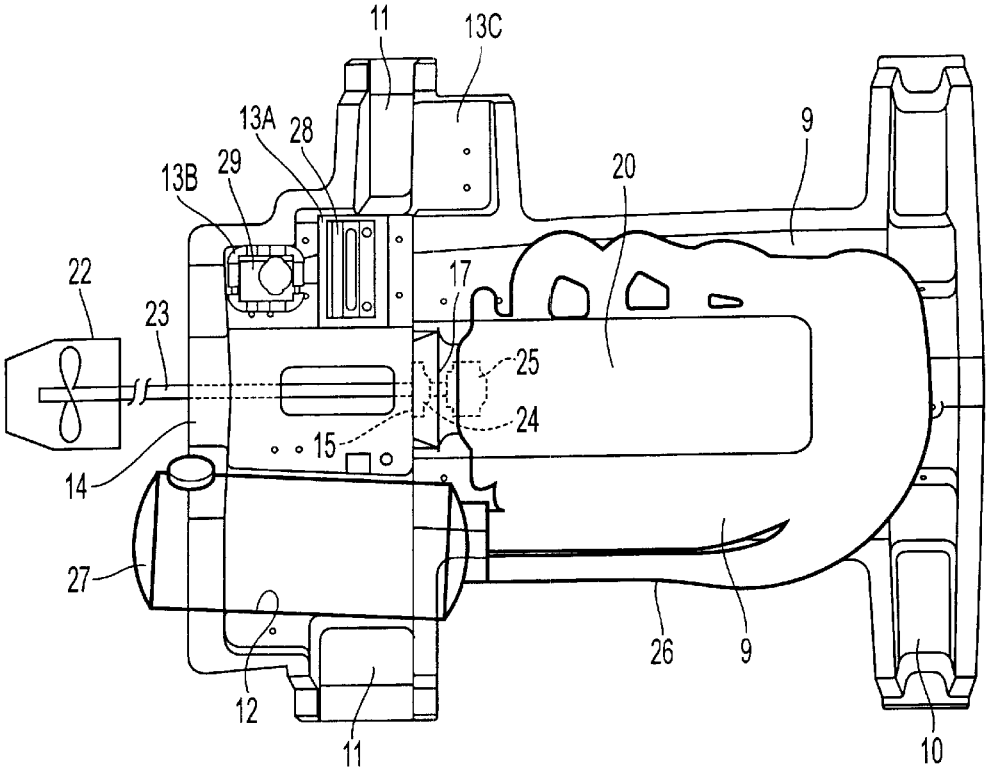
FIG. 6 is a plan view showing the condition in which an engine, a muffler, a propulsion device and a bearing are mounted on the inner frame member.
Figure 7:
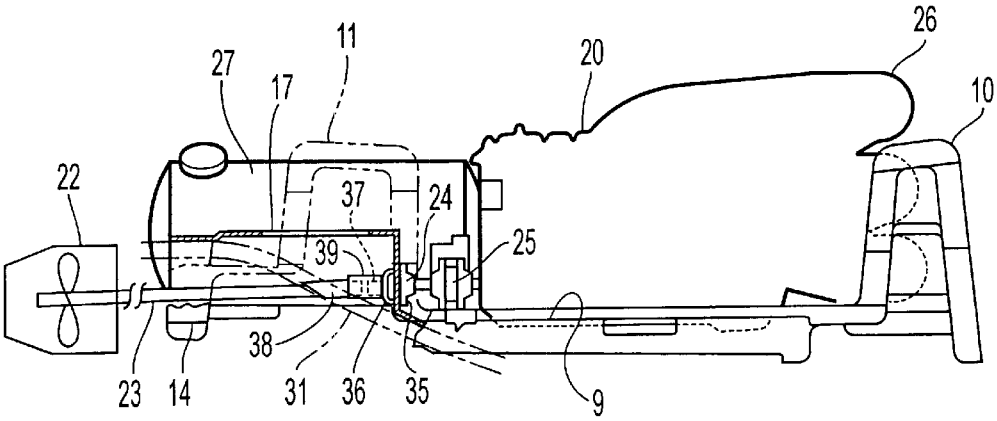
FIG. 7 is a partially cutaway side view showing the condition in which the engine, muffler, propulsion device and bearing are mounted on the inner frame member.

As shown in FIGS. 1–3, the inner frame member 8 is joined to the inner surface of the hull 2, and the engine 20 is then fixed to the engine mount portion 9 of the inner frame member 8 by bolts (not shown), as shown in the plan view of FIG. 6, and the side view of FIG. 7. The propulsion device 22 is fixed to the duct 31 of the hull 2 (FIG. 2), and a front portion of the impeller shaft 23 of the propulsion device 22 is supported on the bearing 24 fixed to the impeller shaft support region 15 of the inner frame member 8 by bolts 35 and stud nuts 36. A front end portion of the impeller shaft 23 and a rear end portion of a drive shaft of the engine 20 are connected together by a coupling 25. The engine 20 and propulsion device 22 are thus connected together. The impeller shaft 23 is covered with a first cylindrical cover 37 fixed to the impeller shaft support region 15, a second cylindrical cover 38 positioned on a rear side of the first cylindrical cover 37 and fixed to the hull 2, and a cylindrical rubber joint 39 connecting the cylindrical covers 37, 38 together. An operation to connect these cylindrical covers 37, 38 by the rubber joint 39 is carried out through the inspection panel 17. In FIG. 7, an upper wall thickness of the duct 31 through which the impeller shaft 23 and the second cylindrical cover 38 are passed is shown by a two-dot chain line.

On the silencer support region 12 of the inner frame member 8 shown in FIG. 6, a silencer 27, such as a water muffler joined to an exhaust pipe 26 of the engine 20 is fixed.

A battery 28 is fixed on the first electric parts support region 13A, and an electric circuit-containing electric parts box 29 on the second electric parts support region 13B.

Figure 8A:
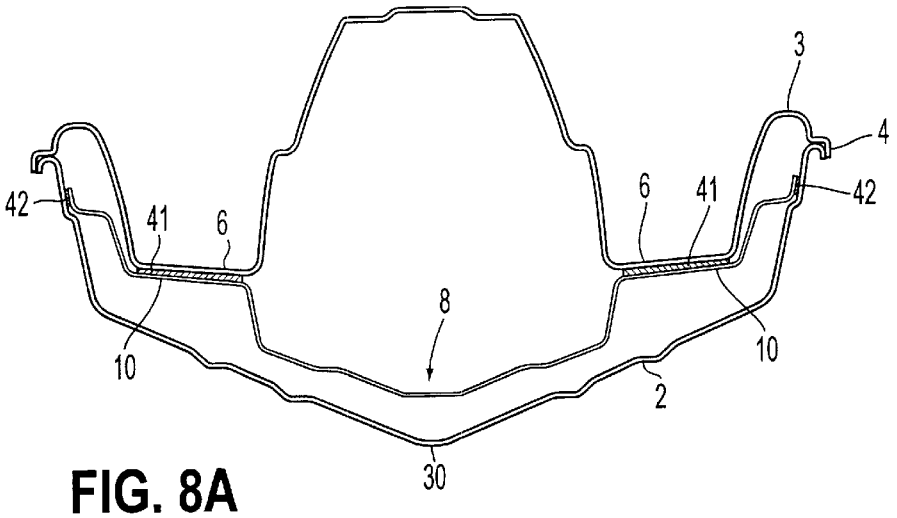
FIGS. 8A, 8B and 8C are sectional views taken along the lines A—A, B—B and C—C in FIG. 2, respectively, and showing the connected condition of the hull, the inner frame member and the deck.
Figure 8B:
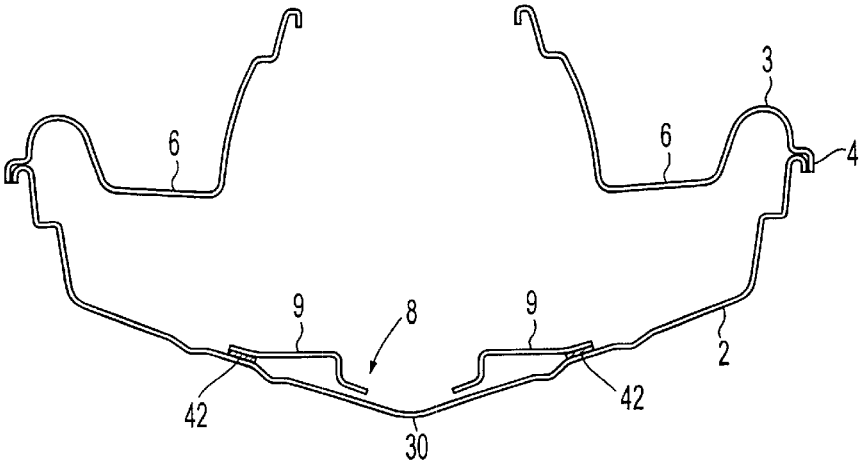
Figure 8C:
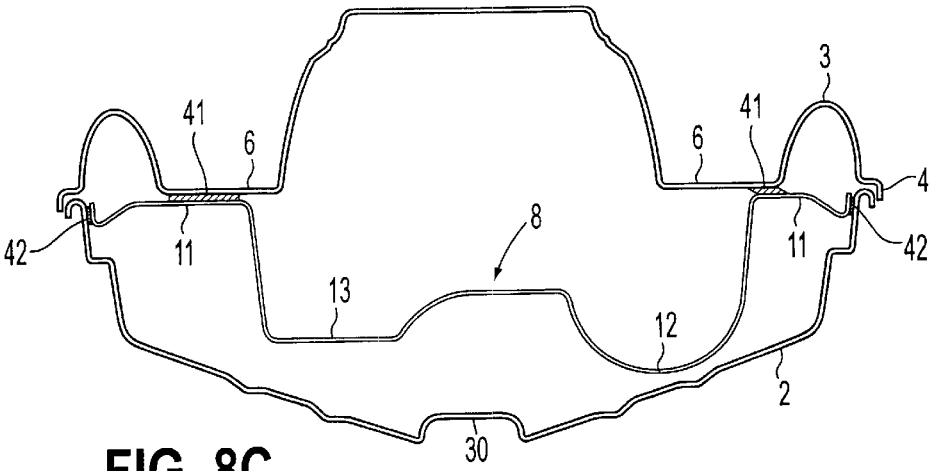

FIG. 8 is a drawing showing the connected condition of the hull 2, deck 3 and inner frame member 8, wherein FIG. 8(A) is a sectional view taken along the line A—A in FIG. 2, FIG. 8(B ) a sectional view taken along the line B—B in FIG. 2, and FIG. 8(C) a sectional view taken along the line C—C in FIG. 2. A reference numeral 30 denotes a keel of the hull 2. As shown in FIG. 8(A), the bulkhead 10 is joined to inner surfaces under surfaces of stepped portions 6 of the deck 3 via adhesive layers 41. As shown in FIG. 8(C), the bulkhead 11 is also joined to the inner surfaces under surfaces of the stepped portions 6 via adhesive layers 41. Thus, the hull 2 and the deck 3 are reinforced with the bulkheads 10, 11. The inner frame member 8 as a whole, including the engine mount portions 9 shown in FIG. 8(B), is joined to the inner surface of the hull 2 via adhesive layers 42.

According to the above-described structure, the hull 2 shown in FIG. 1 of the body 1 of the personal watercraft is divided into three small compartments, i.e. a bow section, an intermediate section and a stern section, by the bulkhead 7 and the bulkheads 10, 11 of the inner frame member 8, so that a torsional rigidity necessary for the body 1 can be secured. Moreover, since the inner frame member 8 has the engine mount portion 9 and the impeller shaft support region 15 shown in FIG. 3, the accuracy of positions in which the engine 20 and the impeller shaft 23 of the propulsion device 22 shown in FIG. 1 are fixed is improved to a level equal to that of a dimensional accuracy of the molded inner frame member 8. Accordingly, the centering of the engine 20 and the impeller shaft 23 can be accomplished easily, and an assembling accuracy of the hull is improved. Furthermore, the inner frame member 8 extends from an intermediate portion of the hull 2 to a rear portion thereof, i.e., the inner frame member 8 is short enough so as to only extend over a distance corresponding to part of the whole length of the hull 2, so that the reduction of the size of the inner frame member 8 enables the weight of the personal watercraft to be reduced. The vertical rigidity of the body 1 can be secured by increasing a wall thickness of the keel 30 shown in FIG. 8 of the hull 2.

In the above mode of embodiment, the bulkhead portion 10 is provided on a bow side part of the inner frame member 8, and the bulkhead portion 11 on a stern side part thereof. Either one of the bulkheads 10, 11 may be formed separately from the inner frame member 8. When the rigidity of the hull 2 is sufficiently high, either one of the bulkheads 10, 11 may be omitted. Moreover, the separately formed bulkhead 7 may also be omitted in some cases.

Numerous modifications and alternative embodiments of the present invention will be apparent to those skilled in the art in view of the foregoing description. Accordingly, this description is to be construed as illustrative only, and is provided for the purpose of teaching those skilled in the art the best mode to carry out the invention. The details of the structure and/or function may be varied substantially without departing from the spirit of the invention, and all modifications which come within the scope of the appended claims are reserved.

What is claimed is:

1. A personal watercraft, comprising:

an engine;

a propulsion device having an impeller shaft driven by the engine;

a hull having an inner surface, a middle portion and a rear portion, a distance from the middle portion to the rear portion defining a first length;

a deck;

an inner frame member joined to the inner surface of the hull along the first length, the inner frame member having an engine mount portion that supports the engine thereon, a total length of the inner frame member being less than a total length of the hull, the inner frame member extending from the middle portion to the rear portion of the hull, the inner frame member also having an impeller shaft support region that supports thereon the impeller shaft of the propulsion device driven by the engine;

a bulkhead extending in a lateral direction of the hull.

2. The personal watercraft according to claim 1, wherein the bulkhead extending in the lateral direction of the hull is provided in the inner surface of the hull, spaced from and forward of the inner frame member, and disposed between the starboard and larboard wall of the hull.

3. The personal watercraft according to claim 1, wherein the inner frame member is joined to both the inner surface of the hull and the deck via adhesive layers.

4. The personal watercraft according to claim 1, wherein the engine is fixed to the engine mount portion of the inner frame member by bolts.

5. The personal watercraft according to claim 1, further including a seat disposed substantially directly above the inner frame member.

6. The personal watercraft according to claim 1, wherein the bulkhead is part of the inner frame member.

7. The personal watercraft according to claim 6, wherein the bulkhead is displayed at a bow side of the inner frame member.

8. The personal watercraft according to claim 7, further including another bulkhead that is part of the inner frame member and disposed at a stern side of the inner frame member.

9. The personal watercraft according to claim 8, further including a hull bulkhead that is provided at the inner surface of the hull, spaced from and forward of the inner frame member.

10. The personal watercraft according to claim 9, wherein the impeller shaft support region is provided at the other bulkhead that is part of the inner frame member and disposed at the stern side of the inner frame member.

11. The personal watercraft according to claim 10, wherein the bulkhead that is disposed at the bow side of the inner frame member is substantially symmetrical relative to a center line.

12. The personal watercraft according to claim 11, wherein the engine mount portion of the inner frame member is substantially symmetrical relative to the center line.

13. The personal watercraft according to claim 9, wherein the bulkhead that is disposed at the bow side of the inner frame member, the other bulkhead that is disposed at the stern side of the inner frame member, and the hull bulkhead have structures so as to enhance torsional rigidity of the personal watercraft.

14. The personal watercraft according to claim 8, wherein the bulkhead disposed at the bow side of the inner frame member and the other bulkhead disposed at the stern side of the inner frame member are each formed to a substantially inverted U-shaped cross section taken in a longitudinal direction of the hull.

15. The personal watercraft according to claim 14, wherein the bulkhead disposed at the bow side of the inner frame member and the other bulkhead disposed at the stern side of the inner frame member each include outwardly extending flanges.

16. The personal watercraft according to claim 15, wherein the outwardly extending flanges are joined to the hull.

* * * * *